US006641111B2

(12) United States Patent
Lorenz et al.

(10) Patent No.: US 6,641,111 B2
(45) Date of Patent: Nov. 4, 2003

(54) DISLODGING A THROTTLE PLATE FROM ICE FORMATION

(75) Inventors: Edwin D. Lorenz, Grand Blanc, MI (US); David M. Preston, Clarkston, MI (US); Donald R. Haefner, Troy, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/056,436

(22) Filed: Jan. 24, 2002

(65) Prior Publication Data

US 2003/0136935 A1 Jul. 24, 2003

(51) Int. Cl.[7] ..... F02D 13/00
(52) U.S. Cl. ..... 251/305; 251/77
(58) Field of Search ..... 251/77–83, 304–317.01

(56) References Cited

U.S. PATENT DOCUMENTS 6,116,215 A * 9/2000 Soleanicov et al. ..... 123/399
6,239,562 B1 * 5/2001 Turner ..... 123/399
6,263,898 B1 * 7/2001 Vanderveen et al. ..... 251/313

* cited by examiner

*Primary Examiner*—Paul J. Hirsch
(74) *Attorney, Agent, or Firm*—Roger A. Johnston

(57) ABSTRACT

A servo motor operated rotary air throttle has a driving member connected to the throttle shaft. The motor rotor is connected to the driving member in a lost motion connection. If the throttle is lodged due to ice formation, the motor rotor acquires rotary momentum relative to the driving member during the lost motion rotation and a projection on the rotor impacts the end of a slot in the driving member to impart a momentum pulse to the driving member and throttle shaft and dislodge the throttle.

10 Claims, 2 Drawing Sheets

DISLODGING A THROTTLE PLATE FROM ICE FORMATION

BACKGROUND OF THE INVENTION

The present invention relates to throttling valves such as rotary throttle plates employed in the air inlet of an internal combustion engine. In particular the invention relates to such engine air throttles which are operated by a servo motor rather than direct mechanical linkage to a driver operated accelerator pedal.

The evolution of engine throttle operation from carbureted engines to electrically operated fuel injected engines has resulted in the desirability of electrically controlling the vehicle throttle from the engine electronic computer in a "drive by-wire" arrangement. Such arrangements are desirable for traction control purposes and improved control under cruise control operation.

Where it has been desired to operate an engine air throttle with a servo motor, it has been proposed to operate the throttle shaft directly with a torque motor mounted on the throttle body with the output of the motor connected to the throttle shaft. In such an arrangement, the torque motor operates against a return spring which biases the throttle to the closed position upon de-energization of the throttle actuator torque motor.

In engines operating with an air throttle and fuel injection as opposed to carburation, the absence of the vaporized fuel in the throttle passage has resulted in greater tendency to form ice from the reduced vapor pressure of the flow without the fuel as the dynamic pressure by the flow velocity through the throttle passage. This formation of ice has resulted in sticking or lodging of the throttle plate when the throttle plate is in the nearly closed or idle position during engine operation. The formation of the ice has provided sufficient lodgment such that the throttle servo motor was subsequently unable to move the throttle.

Therefore, the problem to be solved is to provide a way or means of breaking loose a throttle plate which has been lodged or stuck from ice formation in an electrically operated engine air throttle without the need to substantially increase the power and size of the throttle servo motor in order to have torque available to crack the throttle loose from the ice.

BRIEF SUMMARY OF THE INVENTION

The present invention provides a motorized engine air inlet throttle assembly which solves the above-described problem by providing a lost motion connection between the servo motor rotor and a driving member on the throttle shaft. In the event of throttle plate lodgment due to ice formation, the servo motor rotor rotates through a limited rotation and acquires rotary momentum relative to the driving member on the throttle shaft and subsequently impacts the driving member imparting a momentum transfer pulse to the driving member which is transmitted to the throttle shaft and breaks loose the throttle plate from the ice, thereafter enabling normal throttle operation by the servo motor.

The throttle servo motor is preferably of the type having an external rotor to increase the mass of the rotor which enhances the momentum transfer to the throttle shaft driving member where lost motion rotation has occurred due to throttle stickage. In the preferred embodiment, the throttle shaft driving has an arcuate slot; and, the servo motor rotor has a projection thereon which impacts the edge of the slot to impart a momentum transfer pulse thereto and effect breaking loose of the throttle plate.

DETAILED DESCRIPTION OF THE INVENTION

Figure 1:
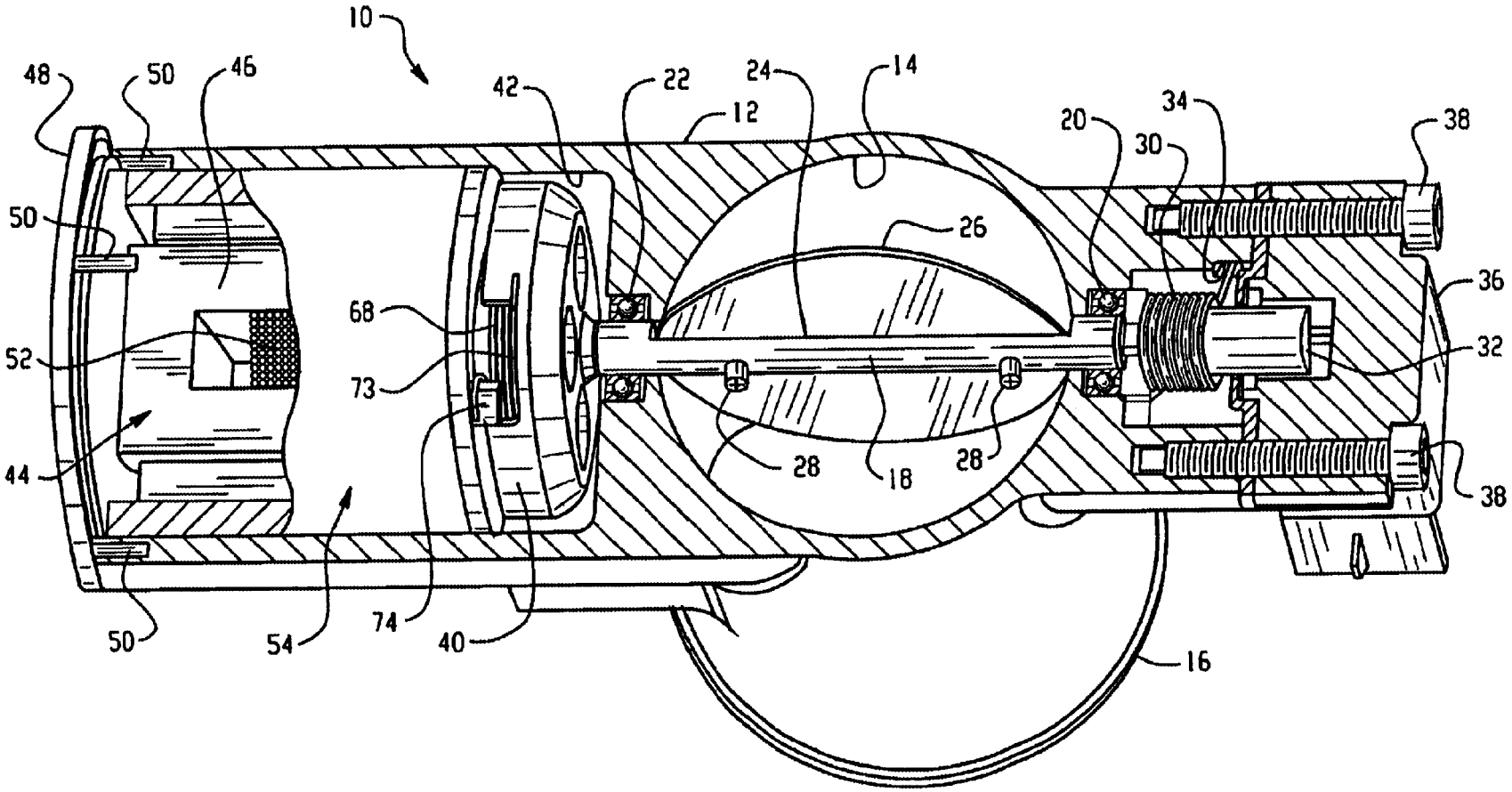
FIG. 1 is a perspective view of the assembly of the present invention with a portion of the throttle body broken away to shown the arrangement of the servo motor with the throttle shaft; and, FIG. 2 is an exploded view of the servo motor rotor and lost motion connection to the throttle shaft driving member of the assembly of FIG. 1.
Figure 2:
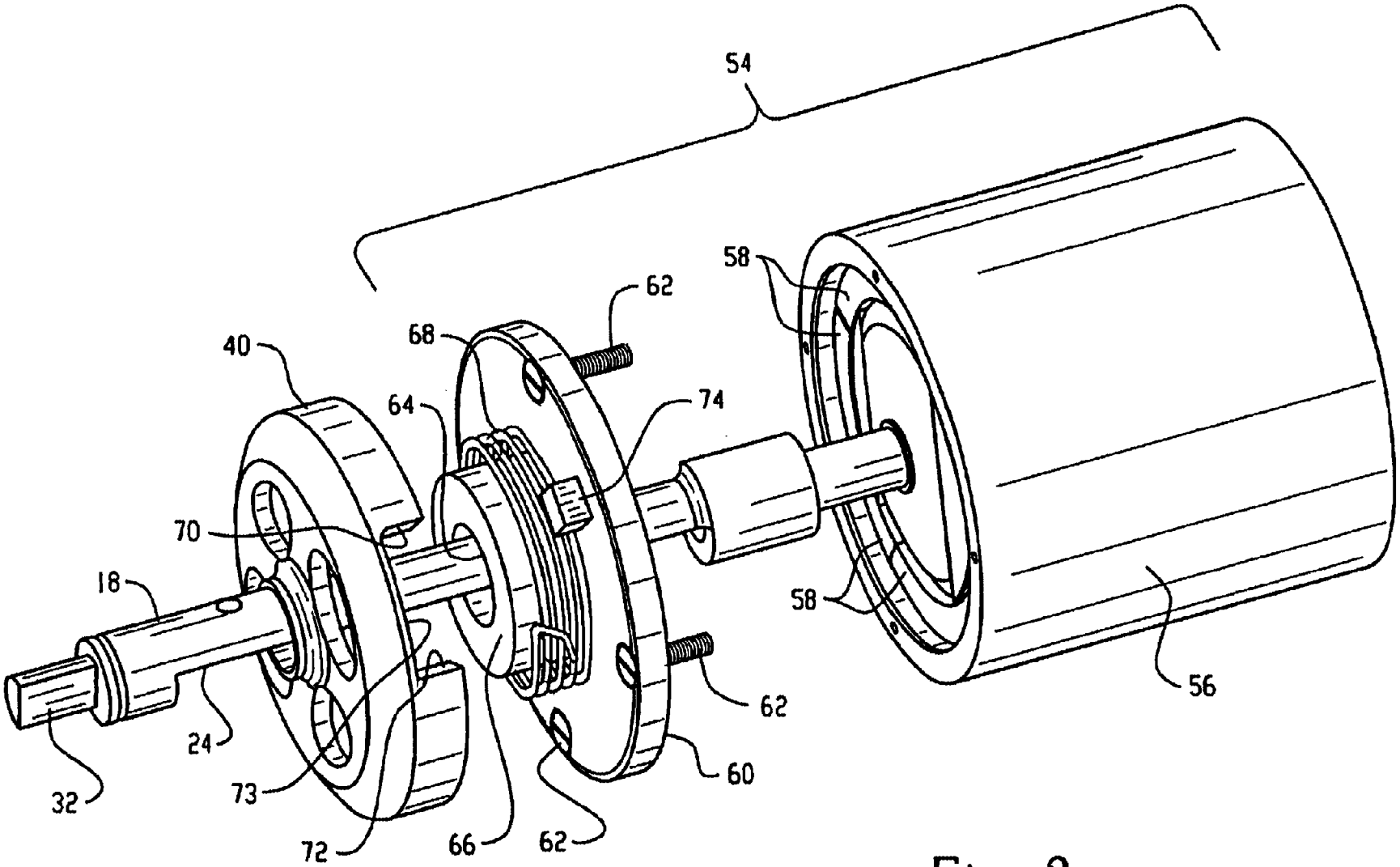

Referring to FIGS. 1 and 2, the throttle valve and motor assembly of the present invention is indicated generally at 10 and includes a throttle body 12 having an engine air passage 14 formed through an air inlet horn 16 portion of the throttle body. It will be understood that the throttle body 12 is broken away in FIG. 1 from the downstream or bottom side as air flows into the passage 14 through inlet horn 16.

The throttle body 12 has a throttle shaft 18 disposed transversely through the air passage 14 and the shaft is journalled for rotation in bearing race assemblies 20, 22 disposed on opposite sides of the passage 14.

Shaft 18 has a cut out or flat portion 24 formed thereon and located such that upon assembly of the shaft 18 in the bearings 20, 22 and through the air passage 14, a throttle plate or disc 26 may be inserted into the air inlet passage 14 and registered against the flat surface 24 on the shaft 18 and secured thereon by suitable fastening means as for example screws 28 threaded into the shaft 18.

Shaft 18 extends axially in a rightward direction beyond bearing 20 as shown in FIG. 1 and has a torsion spring 30 disposed thereon and which has one end thereof attached to the shaft 18 in force transmitting engagement, with the opposite end of the torsion spring 30 secured in a slot 34 formed in the valve body 12. If desired, shaft 18 may have a flat 32 formed on the end thereof for engaging a rotary position sensor. The end of shaft 18 and the spring are covered by a position sensor 36 secured on the body by suitable fasteners such as screws 38. It will be understood that the torsion spring 30 provides a bias torsional force on the shaft 18 in a direction tending to return the valve 26 to a closed position or position blocking airflow through passage 14.

A driving member or hub 40 is received over shaft 18 and secured thereto by any suitable means, as for example press fit over an enlarged portion 39 of shaft 18, weldment, or mechanical fastening and is stationed thereon axially adjacent bearing 22.

Although the driving member 40, in the presently preferred practice comprises a separate member attached to shaft 18, it will be understood that alternatively the shaft and driving member or hub 40 may be formed integrally as one piece if desired.

Valve body 12 has a cavity 42 formed therein into which is received the driving member 40 and a servo motor indicated generally at 44, motor 44 has a stator 46 which is attached to a closure member for cavity 42 in the form of a cap 48 which is secured over the open end of cavity 42 by screws 50 or other suitable fasteners such as press fitted pins. Stator 46 includes a motor coil 52 and has journalled thereon for rotation an external generally cup-shaped rotor indicated generally at 54 as shown in FIG. 2. Rotor 54 comprises a cylindrical shell portion 56 having a plurality of permanent magnets 58 disposed about the inner periphery thereof. Rotor 54 also includes an end cap 58 which is secured to shell 56 by any suitable fastening expedient such as screws 62. However, other fastening techniques may be employed such as staking, crimping or weldment. End cap 60 has a clearance bore 64 formed therein through which is received shaft 18 in free passage therethrough.

Cap 60 has a hub 66 formed thereon with a torsion spring 68 received thereover having one end thereof anchored to the cap 60 and with the opposite end of the torsion spring 68 configured to engage one end 70 of a slot formed in driving member 40 with the opposite end 72 of the slot disposed generally parallel thereto and spaced circumferentially therefrom.

Rotor cap 60 has a lug or projection 74 extending axially therefrom and received in the slot 73 formed in the driving member 40; and, lug 74 is rotationally biased by spring 68 against the edge 70 of slot 73.

In operation, in the event that throttle plate 26 is lodged in the closed position by ice formation or accumulation of foreign material thereon, motor 44 is energized and rotor 54 is rotated such that the projection 74 moves away from the end 70 of the slot and the mass of the rotor assembly 54 acquires a rotational velocity and angular momentum with respect to the driving member 40. Upon the projection 74 traversing the circumferential length of slot 73, lug 74 impacts the end 72 of the slot 73 a pulse from the angular momentum of the rotor assembly to the driving member 40 thus dislodging the throttle plate 26 by the impulse and momentum transfer. It will be understood that the motor 44 may be dithered by rapidly applying current in opposite directions to cause the rotor to reverse rotation and alternately impact lug 74 the opposite ends 70, 72 of the plot 73.

The present invention thus provides a simple and relatively low cost way of dislodging a servo motor operated air inlet throttle by lost motion connection of the servo motor rotor to the throttle shaft. The momentum of the rotor acquired during the lost motion rotation provides an impulse upon impact of a driving projection on the rotor at the end of slot formed in the driving member on the throttle plate shaft. The present invention thus utilizes the momentum acquired by the rotor during the lost motion movement to provide an impulse capable of dislodging the rotor and eliminates the need for increasing the size of the motor to provide more power for ice breaking.

Although the invention has hereinabove been described with respect to the illustrated embodiments, it will be understood that the invention is capable of modification and variation and is limited only by the following claims.

What is claimed is:

1. A motor operated throttle valve assembly subject to ice formation therein comprising:

(a) body structure defining a fluid flow passage;

(b) a valve member disposed in said flow passage and including a shaft rotatable with respect to said body structure;

(c) a driving member affixed to said shaft for effecting rotary movement thereof;

(d) a motor having a rotor with an inertial mass operable upon motor energization for limited rotary movement relative to said driving member, whereupon said rotor impacts said driving member and transfers momentum thereto for dislodging said valve from said ice and thereafter effecting rotary movement of said shaft and valve member;

(e) means operable for providing a biasing force to the throttle shaft in a throttle closing direction.

2. The assembly defined in claim 1, wherein said rotor with inertial mass is disposed concentrically with respect to said driving member.

3. The assembly defined in claim 1, wherein said driving member includes an arcuate slot formed therein and said rotor includes a projection engaging said slot.

4. The assembly defined in claim 1, wherein said means providing said biasing force is selected from a group consisting of a spring, elastic bands and a coil spring.

5. The assembly defined in claim 1, wherein said inertial mass has an annular configuration.

6. The assembly defined in claim 1, further comprising a torsion spring biasing said shaft in one direction.

7. The assembly defined in claim 1, further comprising:

(a) a shaft position sensor operative to provide an electrical indication of the rotational portion of said shaft; and, (b) a controller, including circuitry for receiving said electrical indication of shaft position and operable to alternately energize said motor for forward and reverse rotation for impacting said inertial mass in opposite directions for dislodging ice.

8. A method of dislodging a rotatable throttle valve from ice formed thereon comprising:

(a) disposing a shaft with said throttle valve for effecting rotary movement thereof;

(b) disposing a driving member having driving surfaces thereon for effecting rotary movement of the shaft;

(c) disposing a motor having a rotor with an inertial mass and engaging said rotor in limited lost-motion rotary driving engagement with said driving surface;

(d) energizing said motor and permitting said limited lost-motion rotation thereof and impacting said driving surface with said mass and transferring momentum to said driving member and dislodging said throttle valve and moving said throttle.

9. The method defined in claim 8, wherein said step of energizing said motor includes alternately energizing said motor for rotation in forward and reverse directions.

10. The method defined in claim 8, wherein said step of impacting includes forming an arcuate slot in said driving member and forming a projection on said rotors and impacting said projection on a surface of said slot.

* * * * *